US007207255B2

(12) United States Patent
Felton et al.

(10) Patent No.: US 7,207,255 B2
(45) Date of Patent: Apr. 24, 2007

(54) MUZZLE DEVICE

(75) Inventors: Greg Felton, St. Albans (GB); Richard P. West, St. Albans (GB)

(73) Assignee: Law Enforcement International Ltd., St. Albans (GB)

( * ) Notice: Subject to any disclaimer, the term of this patent is extended or adjusted under 35 U.S.C. 154(b) by 0 days.

(21) Appl. No.: 10/983,674

(22) Filed: Nov. 9, 2004

(65) Prior Publication Data

US 2006/0048639 A1 Mar. 9, 2006

(30) Foreign Application Priority Data

Sep. 3, 2004 (GB) ..... 0419612.7

(51) Int. Cl.
*F41A 21/00* (2006.01)

(52) U.S. Cl. ..... 89/14.3; 89/14.4

(58) Field of Classification Search ..... 89/14.2–14.6; 181/223

See application file for complete search history.

(56) References Cited

U.S. PATENT DOCUMENTS 953,943 A * 4/1910 Childress ..... 181/223
958,935 A * 5/1910 Maxim ..... 181/223
959,400 A * 5/1910 Stinson ..... 181/223
984,750 A * 2/1911 Craven ..... 181/223
1,390,447 A 9/1921 Johnston
3,776,093 A * 12/1973 Leverance et al. ..... 89/14.4
4,649,798 A * 3/1987 Phillips ..... 89/14.4
4,691,614 A 9/1987 Leffel et al.
5,076,137 A 12/1991 Paredes
5,136,924 A * 8/1992 Forster et al. ..... 89/14.4
6,516,700 B1 2/2003 Nikonov et al.

FOREIGN PATENT DOCUMENTS

GB 125898 5/1919

* cited by examiner

*Primary Examiner*—Michael J. Carone
*Assistant Examiner*—Gabriel J. Klein
(74) *Attorney, Agent, or Firm*—Greenblum & Bernstein P.L.C.

(57) ABSTRACT

The present invention relates to a muzzle device for countering muzzle climb of a firearm muzzle 1, the muzzle device. The device comprises a chamber 5 having entry and exit apertures arranged for alignment with the path of a projectile expelled from the muzzle. The chamber is arranged to be asymmetric in relation to the projectile path, with a greater chamber volume being provided above the projectile path.

13 Claims, 3 Drawing Sheets

MUZZLE DEVICE

The present invention relates to a muzzle device for use with firearms, including both small arms and artillery, and more particularly to a muzzle device which can reduce recoil and muzzle climb, whilst limiting undesirable effects of flash, sand patterning and muzzle blast.

In this connection, firearms typically exhibit the problems of recoil and muzzle climb when fired, both of which can greatly affect the accuracy of a shot, particularly if multiple shots are fired with a fully automatic firearm, since they cause the firearm to move off target. Recoil is caused by the back force generated upon detonation of the charge when a firearm is fired. The related problem of muzzle climb, where the gun barrel rises when fired, is due to the recoil force acting along the axis of the barrel, the axis being above the point of resistance which supports the firearm. For example, in firearms such as a rifle or shotgun, the butt of the weapon is supported against the user's shoulder, whereas in handguns the firearm is supported at the grip. In both cases the support for the firearm is positioned below the barrel to allow a user to aim down the barrel. When a shot is fired, the force of the recoil acts along the axis of the barrel, but as this force vector is above the butt or grip of the firearm, a moment force is created which causes the barrel to pivot upward.

In this regard, there has long been a continued effort to reduce the effects of recoil and muzzle climb in firearms. Such recoil and muzzle climb are particularly problematic in higher powered and/or high rate of fire firearms such as assault rifles and light machine guns, and as such, can significantly reduce accuracy during rapid firing.

To this end, it is well known that when a firearm is fired, jets of gas are formed within the barrel muzzle due to the expansion of gasses upon detonation of the cartridge. Additionally, jets of gas are also formed as the bullet is propelled forward through the barrel, caused by the compression of gasses in front of the bullet as it moves forward. Conventional muzzle brakes use the impact of the forward momentum of these jets of gas to counter act the recoil and muzzle climb. Specifically, conventional muzzle brakes, which commonly fit on the end of the barrel, are used to deflect some of the jets of gas to the side as they exhaust from the barrel of the gun. As these jets hit the muzzle brake, the forward impulse force formed on the muzzle brake counteracts the backward force of the recoil.

By similar means, to combat muzzle climb, muzzle brakes typically deflect more gas upward than down. Subsequently, there is a downward force created on the muzzle brake as the gas jets exhaust. This downward force counteracts the upward force formed on detonation of the charge and thereby alleviates muzzle climb.

Whilst such conventional muzzle brakes have proved efficient at reducing recoil and muzzle climb they have a problem in that they increase the unwanted signature effects of flash and muzzle blast.

Flash is caused by the incomplete combustion of gasses as they exhaust from the barrel. Specifically, when a weapon is fired, the gases released are typically still burning when they exhaust from the barrel. As such, a 'flash' of light can commonly be seen as these gases dissipate and burn off. Muzzle blast is caused by the shockwave exiting the weapon's barrel.

With conventional muzzle brakes, gasses are usually directed sideways as they exit the barrel. Subsequently, some of the gasses which would normally be passed out the end of the barrel, where they may have been hidden or diffused by a flash hider or diffuser, are directed sideways resulting in an increase in flash and muzzle blast. There is also an increase in the blast in the direction of the diverted gas, and hence there is an increase in the blast to those located near to or behind the gun.

Additionally, an increase in muzzle blast can also increase the effects of sand patterning, in which dust or sand is blown into the air by the shockwave produced on firing. These effects are detrimental in that they make the weapon more noisy and draw attention when the firearm is used, identifying the location of fire. Indeed, in efficient muzzle brakes, which divert a significant amount of the exhaust gasses, these effects are particularly problematic.

Hence, an object of the present invention is to provide a muzzle device which seeks to alleviate such known problems.

According to the present invention, there is provided a muzzle device for countering muzzle climb of a firearm muzzle, the muzzle device comprising:—a chamber having entry and exit apertures arranged for alignment with the path of a projectile expelled from the muzzle; wherein the chamber is arranged to be asymmetric in relation to the projectile path, with a greater chamber volume being provided above the projectile path.

In this way, when a firearm is fired, the detonation of the charge and the action of the projectile moving through the barrel results in jets of gases rushing forward. As these gases enter the chamber and impact against the walls, the asymmetrical configuration produces a relative forward and downward force counteracting the effects of muzzle climb and recoil.

Additionally, once the gasses have impacted against the walls of the chamber, they are diverted around the chamber creating a turbulence effect. This turbulence acts to further slow any gasses still entering the chamber. It also increases the dwell time of the gasses before they are exhausted, providing more time to continue combustion of the gasses and thereby mollifying flash, muzzle blast and flash signatures.

Conveniently, the muzzle device further comprises attachment means for allowing removable attachment to a firearm muzzle. In this way, the muzzle device can be fitted to an existing firearm and can be detached and reattached if necessary.

Conveniently, there is further provided a correction tube disposed along the projectile path at said exit aperture and having a narrow elongate configuration for stabilizing gas flow exiting said chamber. In this way, the narrow elongate correction tube causes the gas exiting the chamber to form a stabilized flow, reducing its turbulence as it passes along the correction tube, and thus stabilizes the gas before it is exhausted.

Conveniently, said correction tube transfers said gas flow to a flash diffuser or flash hider. In this way, the exhaust gasses are further dissipated through a flash diffuser, thereby reducing the flash signature.

Conveniently, said chamber is one of a drum shape, a disc shape, a cylinder shape, a spherical shape, a lozenge shape, a rhomboidal shape, a triangular shape, and an elliptical shape. In this way, different shaped chambers may be employed depending on the requirements of a user or the specifications of the firearm being used.

Conveniently, said device is sealed to the extent that the gasses from the chamber may only exit through the exit aperture and the correction tube. In this way, by restricting the venting of the gasses, the forces generated in the turbulence chamber 5 are used effectively and the gasses are directed though the correction tube for stabilization.

Conveniently, said device further comprises a bleed tube for bleeding off a portion of gas back to the firearm mechanism for providing a force to, for example, assist with unlocking the breach mechanism or to cycle the action of the firearm. In this way, the present invention may be used with an automatic firearm in the action of firing of the next bullet.

Examples of the present invention will now be described with reference to the accompanying drawings, in which:—

FIGS. 1 and 2 show an example of muzzle device according to an embodiment of the present invention.

Figure 1:
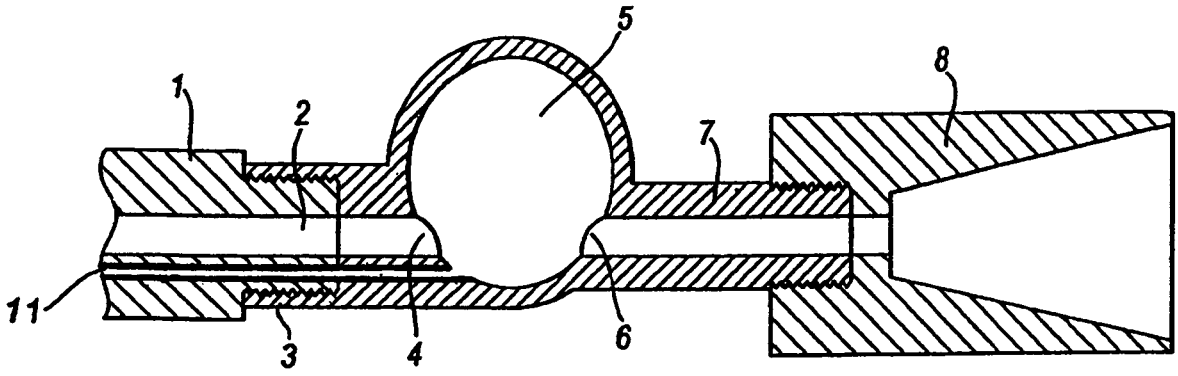
FIG. 1 shows a cut away view of a muzzle device of a first embodiment of the present invention.

A muzzle device 10 can connected to the end of a muzzle 1 of a firearm adjacent its bore and along the axis of its barrel 2. As shown in FIG. 1, the muzzle device is connected to the muzzle 1 by means of a threaded configuration disposed on the inner circumference of connection port 3. In its connected state, the muzzle barrel 2 is aligned with an entry aperture 4. Alternatively, the muzzle device could be connected to the muzzle 1 by means of a quick-detach fitting. For example, a snap-fit, bayonet or click-in type fixture could be used to facilitate quick attachment of the muzzle device.

In this connection, entry aperture 4 opens out into turbulence chamber 5. In this example, turbulence chamber 5 has a cylindrical or drum shape, with the entry aperture 4 opening at the side of the cylinder. Alternatively, the turbulence chamber 5 may be other shapes, for example, spherical, triangular, elliptical or lozenge shape. The size of the turbulence chamber 5 used is dependent upon the size and type of firearm with which it is intended to be used and the braking requirements. For example, in a preferred embodiment of the present invention for use with a 5.56 mm firearm, such as an M16 rifle, a chamber having a cylindrical diameter of 31.75 mm and a width of 25.4 mm can be used, however alternative sizes and dimensions may also be used.

The turbulence chamber 5 is configured such that its axis is offset or asymmetrical with regard to the axis of the barrel. In this way, the barrel axis passes through the turbulence chamber leaving a relatively larger space above the barrel axis than beneath it. For efficient operation of the device it is preferable that the muzzle 1 of the firearm does not protrude into the turbulence chamber 5.

Exit aperture 6 opposes the entry aperture 4 and connects the turbulence chamber 5 to correction tube 7. In this way, the barrel 2, the entry and exit apertures 4 and 6, and the correction tube 7 are all positioned along a common axis.

Finally, diffuser 8 is provided on the distal end of the correction tube 7.

Upon firing the firearm, a charge is detonated there within and a bullet is rapidly accelerated through the barrel 2 of muzzle 1. From here the bullet passes through the entry aperture 4, through the turbulence chamber 5, through exit aperture 6, and out through correction tube 7.

The detonation of the charge causes a massive expansion of the gasses within the barrel 2. This, together with the subsequent acceleration of the bullet through the barrel 2, causes jets of gas to be forced forward along the barrel.

As these jets of gas enter the asymmetrical turbulence chamber 5, the gas above the axis of barrel 2 expands into the large space above, reducing its pressure and velocity. The gas beneath the barrel axis is prevented from expanding as rapidly due to the relatively small space beneath, and hence becomes relatively pressurised. Accordingly, as there is a higher pressure at the bottom of the chamber, the gasses exert a force in the downward direction, thereby counteracting the upward muzzle climb of the weapon.

Additionally, the pressure gradient formed between the lower and upper portions of the turbulence chamber 5, along with the acceleration of gasses into the chamber, creates turbulence in the gasses and disrupts the gas flow within the chamber. This turbulence rapidly slows the gasses which acts to afford a forward force on the turbulence chamber 5. This forward force counteracts the backward force of the recoil.

The turbulence also increases the dwell time of the hot gasses within the device, allowing the combustion of the detonated charge to continue for longer.

The gas exits the turbulence chamber through the correction tube 7. The correction tube 7 serves to stabilize the turbulent gas flow as it transfers it to the diffuser 8. Specifically, the correction tube 7 has a narrow elongate configuration which causes the gas exiting the chamber to form a stabilized flow, reducing its turbulence as it passes along the correction tube, and thus stabilizes the gas before it is exhausted.

The diffuser (flash hider) 8 is mounted symmetrically to the correction tube 7 and the barrel axis. The gas expelled from the correction tube 7 is dissipated through the diffuser 8. Since this gas exiting has had an increased dwell time within the turbulence chamber 5, it is more completely combusted, and therefore the amount of flash is reduced.

Preferably, the turbulence chamber 5 and correction tube 7 are sealed to the extent that they have only entry and exit apertures and no other vents. As such, the gasses may only exit through the exit aperture 6 and the correction tube 7. In this way, by restricting the venting of the gasses, the forces generated in the turbulence chamber 5 are used effectively and the gasses are directed though the correction tube for stabilization.

The device may also comprise a bleed tube 11 for bleeding off a small portion of the gas back to the firearm mechanism for providing a force to, for example, assist with unlocking the breach mechanism or to cycle the action of the firearm. In this way, the present invention may be used with an automatic firearm to action the firing of the next bullet. Furthermore, by bleeding off gas from the device, rather than a gas port on the barrel, relatively lower and stabilized pressure gas can be bled off at a different stage in the time/pressure curve compared with bleeding gas directly from the barrel. Accordingly, more reliable cycling of the action may be achieved.

The present invention therefore provides a muzzle device for counteracting muzzle climb, recoil and flash of a firearm.

Figure 2:
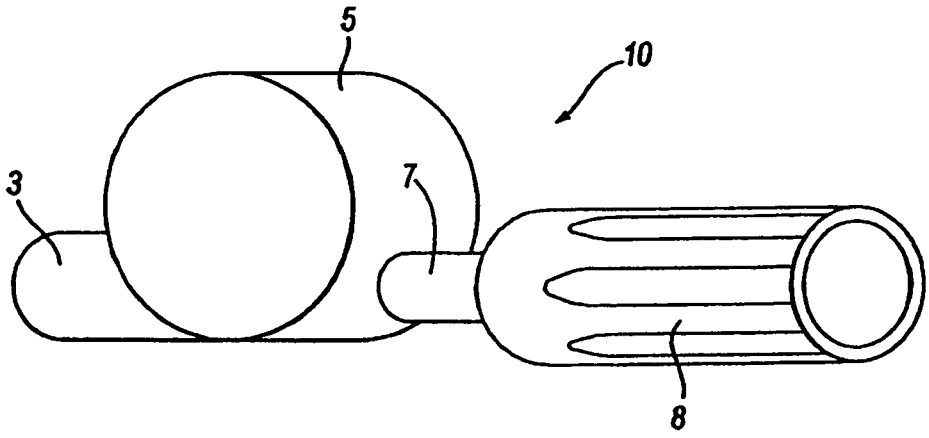
FIG. 2 shows a perspective view of a muzzle device of a first embodiment of the present invention.
Figure 3:
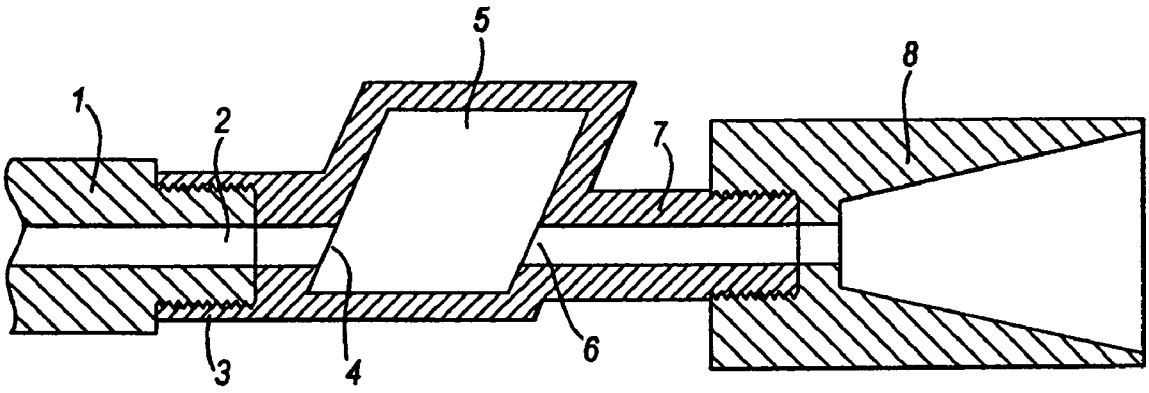
FIG. 3 shows a cut away view of a muzzle device of a second embodiment of the present invention.
Figure 4:
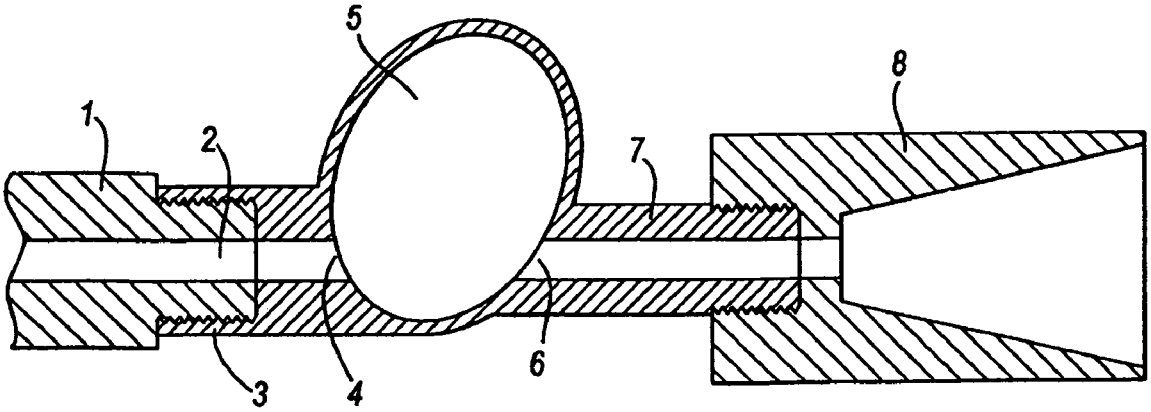
FIG. 4 shows a cut away view of a muzzle device of a third embodiment of the present invention.
Figure 5:
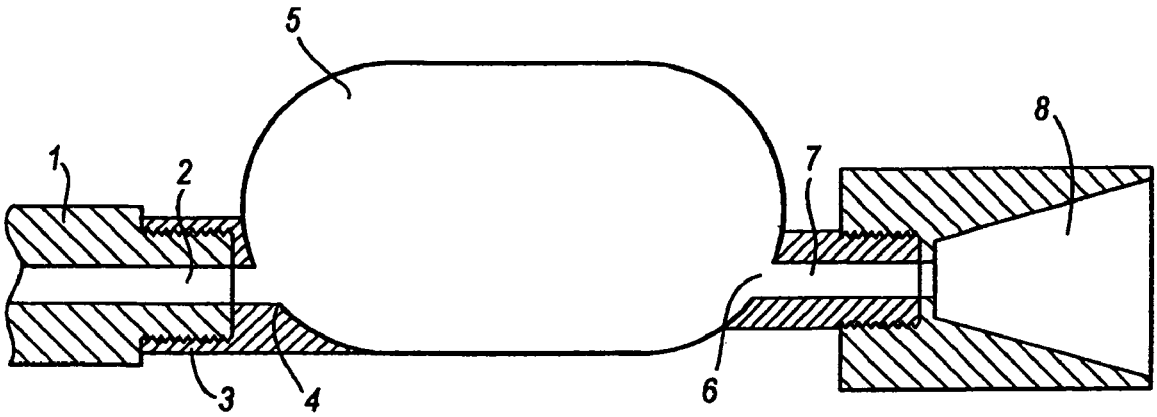
FIG. 5 shows a cut away view of a muzzle device of a fourth embodiment of the present invention.
Figure 6:
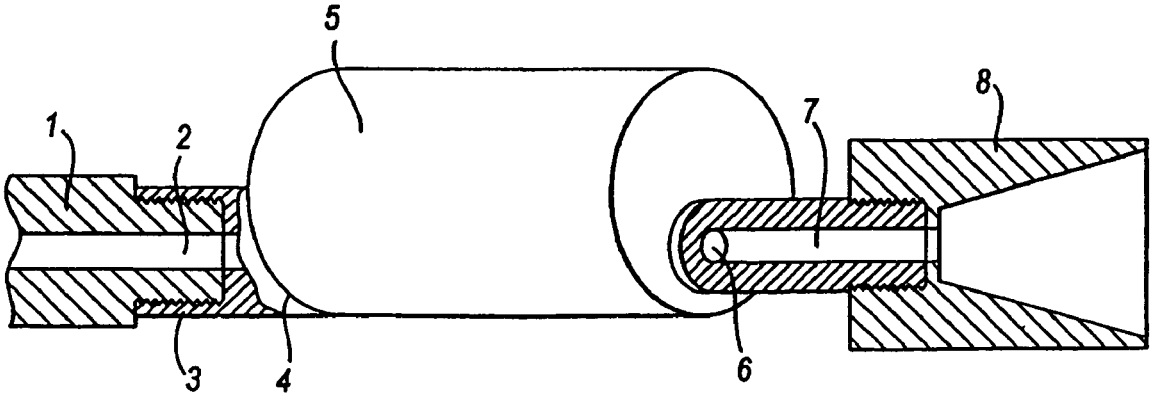
FIG. 6 shows a cut away view of a muzzle device of a fifth embodiment of the present invention.

FIGS. 3, 4, 5 and 6 show four further embodiments of a muzzle device according to the present invention. FIG. 3 shows an embodiment in which the chamber 5 has a rhomboidal shape. FIG. 4 shows an embodiment in which the chamber 5 has an elliptical shape. FIG. 5 shows an embodiment in which the chamber 5 has a cylindrical tube shape with hemispherical ends. FIG. 6 shows an embodiment in which the chamber 5 has an alternative type of cylinder shape. The operation and function of the chamber 5 in these embodiments is substantially similar to the embodiment described above in reference to FIGS. 1 and 2.

Accordingly, it will be understood that a wide variety of shapes and configurations can be used for the chamber 5, provided that the chamber 5 is arranged to be asymmetric in relation to the projectile path, with a greater chamber volume being provided above the projectile path. As such, the illustrated embodiments described herein show applications of the invention only for the purposes of illustration. In practice the invention may be applied to many different configurations the detailed embodiments being straightforward to those skilled in the art to implement. For example, the muzzle device may be formed integrally with the firearm muzzle.

The invention claimed is:

1. A muzzle device for countering muzzle climb of a firearm muzzle, the muzzle device comprising:

a chamber having entry and exit apertures arranged for alignment with the path of a projectile expelled from the muzzle, wherein the chamber is arranged to be asymmetric in relation to the projectile path, with a greater chamber volume being provided above the projectile path; and a correction tube disposed along the projectile path at said exit aperture and having a narrow elongate configuration for stabilizing a gas flow exiting said chamber prior to the gas flow being exhausted, wherein the muzzle device is configured to reduce muzzle climb.

2. The muzzle device according to claim 1, wherein said muzzle device further comprises an attacher configured to permit removable attachment of the muzzle device to a firearm muzzle.

3. The muzzle device according to claim 1, further comprising a flash diffuser or a flash hider that receives gas flow from the correction tube.

4. The muzzle device according to claim 1, wherein said chamber is one of a drum shape and a cylinder shape.

5. The muzzle device according to claim 1, wherein the device is sealed to the extent that it has no vents.

6. The muzzle device according to claim 1, wherein the chamber further comprises a bleed tube for bleeding off a portion of gas flow back to a firearm mechanism.

7. The muzzle device according to claim 1, wherein the greater chamber volume is provided above the projectile path when the device is in a normal firing position.

8. The muzzle device according to claim 1, wherein said device is configured such that, when fitted to the firearm, the muzzle of the firearm terminates before the entry aperture.

9. The muzzle device according to claim 1, wherein the greater chamber volume is provided above the projectile path and a lesser chamber volume is provided below the projectile path.

10. The muzzle device according to claim 1, wherein the asymmetric arrangement of the chamber in relation to the projectile path is configured to produce a downward force that counteracts upward muzzle climb.

11. The muzzle device according to claim 1, wherein the asymmetric arrangement of the chamber in relation to the projectile path is configured to produce a forward force that counteracts recoil.

12. The muzzle device according to claim 1, wherein the narrow elongate configuration of the correction tube is configured to reduce turbulence of the gas flow.

13. The muzzle device according to claim 1, wherein said chamber is one of a disc shape, a spherical shape, a lozenge shape, a rhomboidal shape, a triangular shape, and an elliptical shape.

* * * * *